US006537164B1

(12) United States Patent
Hsu

(10) Patent No.: US 6,537,164 B1
(45) Date of Patent: Mar. 25, 2003

(54) ELASTIC SHEATH DAMPERS IN TENNIS RACKET THROAT

(76) Inventor: Henry Hsu, P.O. Box 697, Feng-Yuan City 420 (TW)

( * ) Notice: Subject to any disclaimer, the term of this patent is extended or adjusted under 35 U.S.C. 154(b) by 0 days.

(21) Appl. No.: 09/987,783

(22) Filed: Nov. 16, 2001

(51) Int. Cl.[7] ..... A63B 7/02
(52) U.S. Cl. ..... 473/521; 473/546
(58) Field of Search ..... 473/524, 546, 473/531, 535, 520, 521

(56) References Cited

U.S. PATENT DOCUMENTS

| | | | | |
|---|---|---|---|---|
| 4,052,060 A | * | 10/1977 | Balkcom | 473/531 |
| 4,367,871 A | * | 1/1983 | Schiefer | 473/463 |
| 4,906,002 A | * | 3/1990 | Goffney et al. | 473/531 |
| 4,915,382 A | * | 4/1990 | Madsen | 473/531 |
| 5,071,125 A | * | 12/1991 | Shen | 473/521 |
| 5,175,919 A | * | 1/1993 | Lo | 473/535 |
| 5,560,600 A | * | 10/1996 | FitzSimons et al. | 473/463 |
| 5,749,574 A | * | 5/1998 | Curtis | 473/531 |
| 5,865,694 A | * | 2/1999 | Duong-Van | 473/520 |

FOREIGN PATENT DOCUMENTS

| | | | |
|---|---|---|---|
| DE | 605166 | * 11/1934 | 473/FOR 181 |
| GB | 420966 | * 12/1934 | 473/FOR 181 |

* cited by examiner

*Primary Examiner*—Raleigh W. Chiu

(57) ABSTRACT

Elastic sheath dampers in tennis racket throat include a racket having a frame, a stringing surface in the frame and a throat separated from a handle to respectively form a truncated triangular configuration and a Y-shaped configuration each of which has a pair of hollow interior branches made engageable with each other and connected by a pair of cylindrical bars by adhesives respectively. The cylindrical bars each has a pair of elastic sheaths respectively sleeved on two ends and inserted into the branches. Thereby the shock waves from the frame are absorbed twice by the elastic sheaths in the throat without transmitting to the handle.

2 Claims, 4 Drawing Sheets

(1—1)

ELASTIC SHEATH DAMPERS IN TENNIS RACKET THROAT

BACKGROUND OF THE INVENTION

The present invention relates to tennis racket and more particularly to an elastic sheath dampers in tennis racket throat which absorbs the shock waves from the frame without transmitting to the handle of the racket.

The shockproof device in a tennis racket is very important. It prevents the shock waves from transmitting to the handle of a racket in order to protect the hand of a player and to promote the scores of the player in a competition. Generally, a hit of a tennis racket against a flying ball creates a great deal of the shock waves. If the tennis racket has no any shockproof arrangement, the shock waves will transmit to the handle of the racket that injure the hand and wrist of the player and gradually cause a tennis elbow. Thus, many tennis rackets in the market have different shockproof devices. However, the result is not as expected.

SUMMARY OF THE PRESENT INVENTION

The present invention has a main object to provide an elastic sheath dampers in tennis racket throat to prevent the shock waves from transmitted to the handle of the racket.

Accordingly, the tennis racket of the present invention comprises generally a head or frame, a throat and a handle. The throat is separated from the handle to form a roughly truncated triangular configuration. While, the handle forms a Y-shaped configuration. The throat and the handle each has a pair of hollow interior tubular branches connected by a pair of cylindrical bars. Each of the cylindrical bars has a pair of elastic sheaths respectively secured to two ends thereof. So that the shock wave from the head is absorbed in the throat and will not transmit to the handle.

The present invention will become more fully understood by reference to the following detailed description thereof when read in conjunction with the attached drawings.

DETAILED DESCRIPTION OF THE PREFERRED EMBODIMENT

Figure 1:
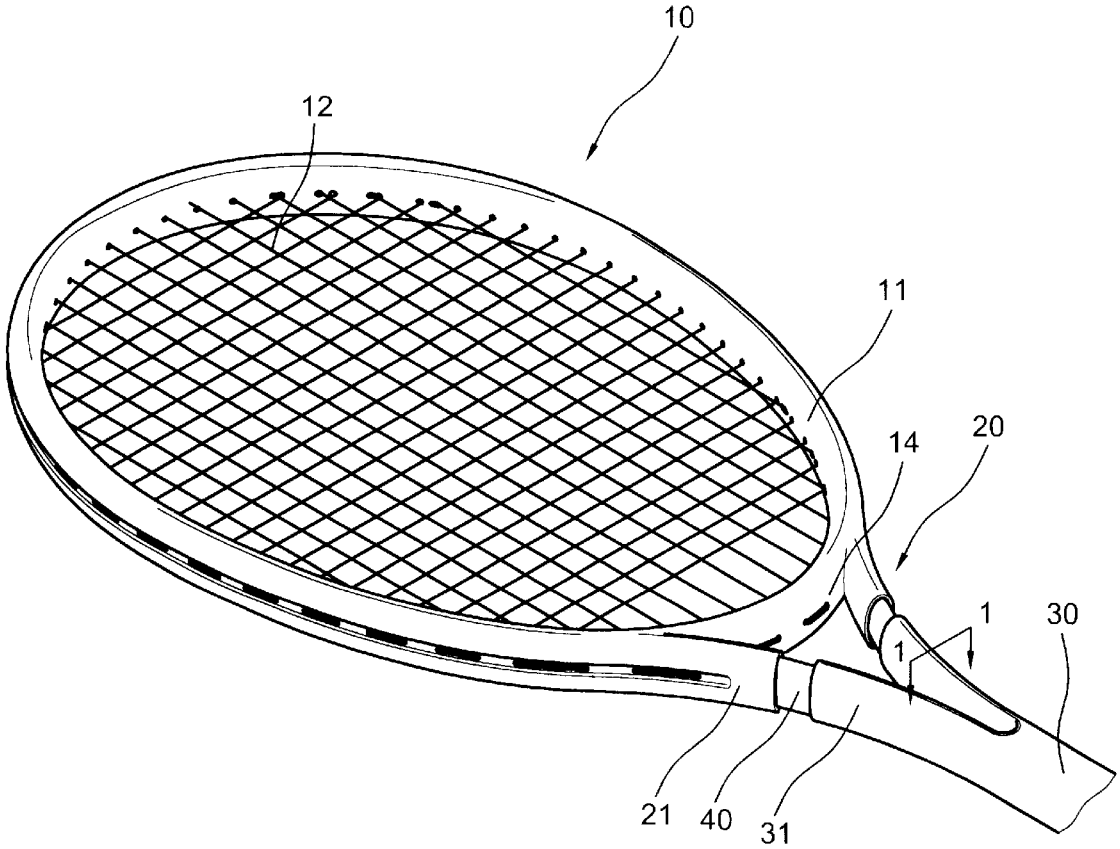
FIG. 1 is a perspective view to show a tennis racket of a preferred embodiment of the present invention.
Figure 2:
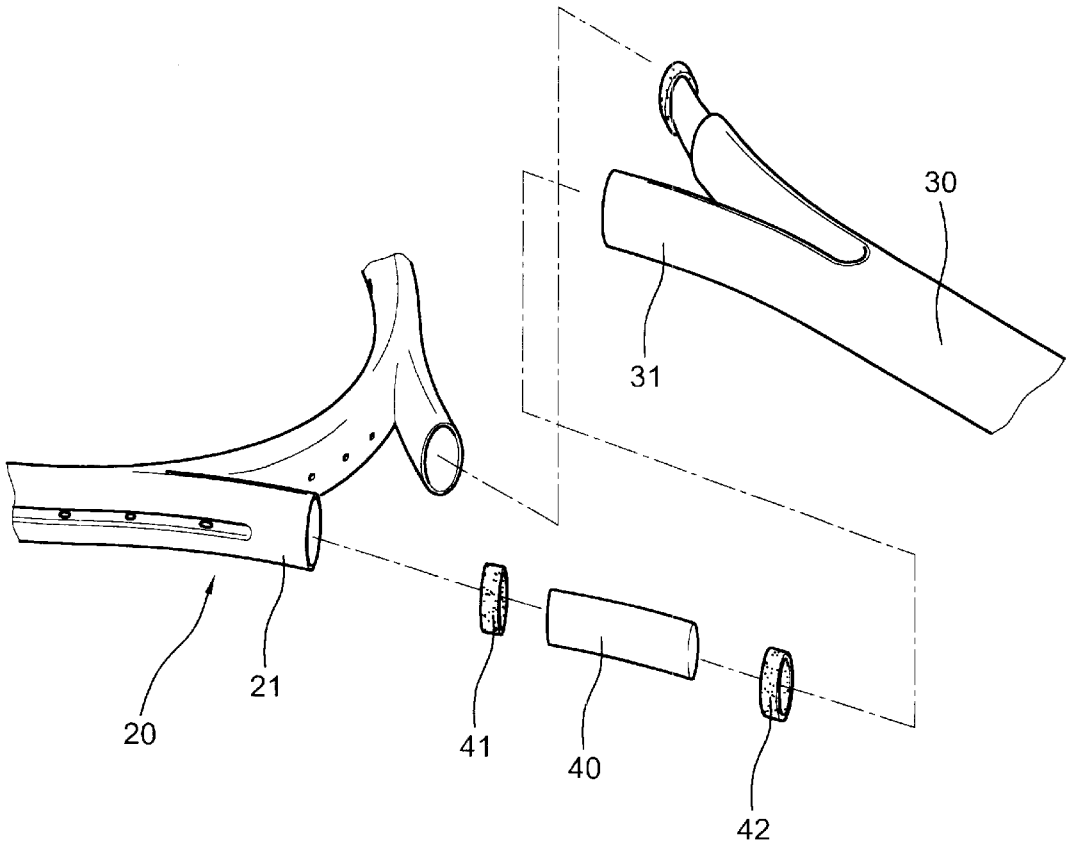
FIG. 2 is an exploded perspective view of FIG. 1.
Figure 3:
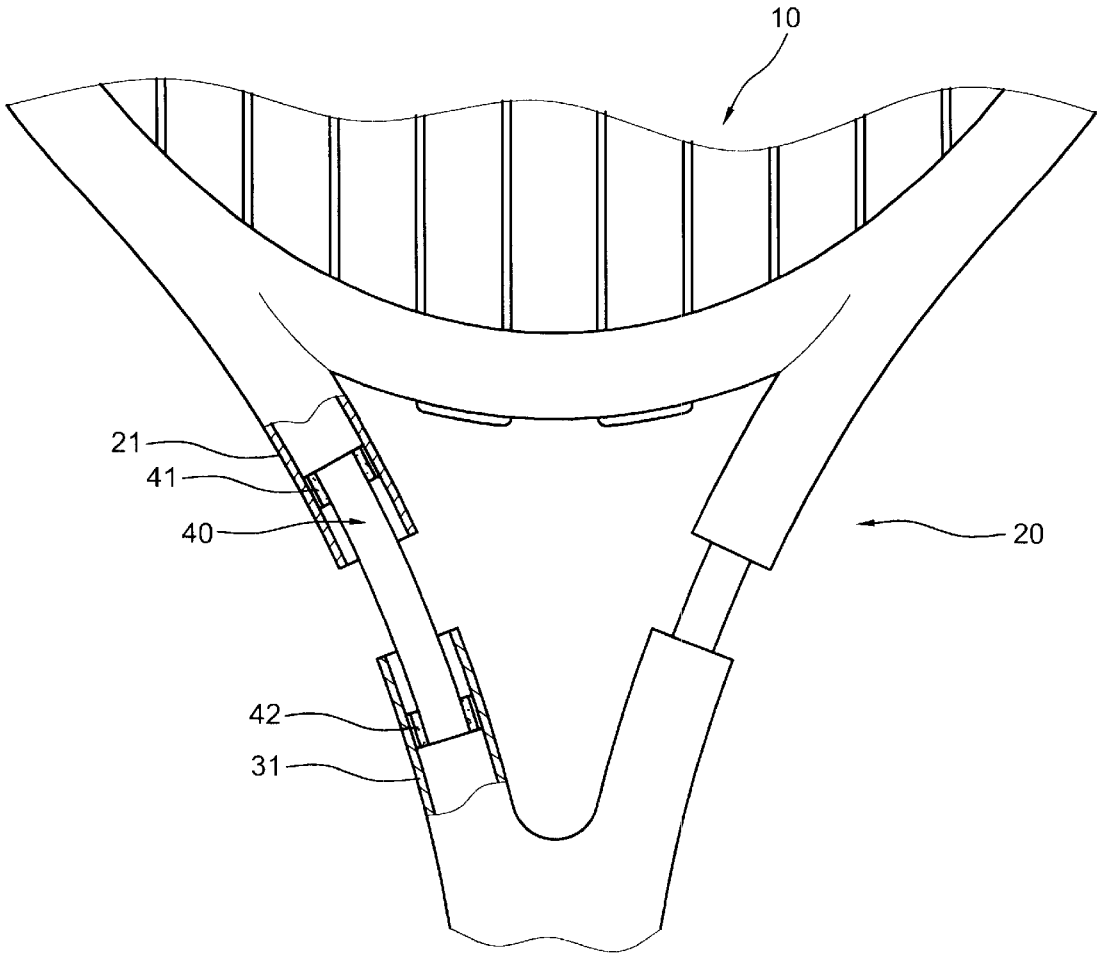
FIG. 3 is a sectional view to show the assembly of FIG. 2.
Figure 4:
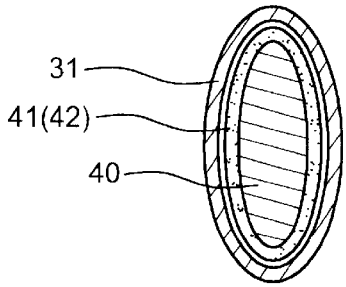
FIG. 4 is a sectional view taken along line 1—1 of FIG. 1.

With reference to FIGS. 1 and 2 of the drawings, the elastic sheath dampers in tennis racket throat of the present invention comprises generally a racket 10 having a head or frame 11, a stringing surface 12 formed inside the frame 11, a throat 20 and a handle 30. The throat 20 is separated from the handle 30 to form a roughly truncated triangular configuration and has a pair of hollow interior tubular branches 21. The handle 30 forms a roughly Y-shaped configuration and has a pair hollow interior tubular branches 31 connected with the branches 21 of the throat 20 by a pair of the cylindrical bars 40. Each of the cylindrical bars has an outer diameter slightly less than the inner diameter of the branches 21 and 31 and a pair of elastic sheaths 41 and 42 respectively engaged on two ends of the bar 40. When connecting the throat 20 with the handle 30 by the cylindrical bar 40, adhesives are applied to the elastic sheath 41 and 42. Then respectively inserts two ends of the cylindrical bars 40 into the branches 21 of the throat 20 and the branches 31 of the handle 30 to having the middle portion of the cylindrical bars 40 exposed to outside of the branches 21 and 31 (as shown in FIGS. 1, 3 and 4). The connections of the branches 21 and 31 and therefore accomplished as the adhesives are dried out.

Based on the above discussed structure, when a plying ball hits at the tennis racket 10. The shock waves from the stringing surface 12 will be absorbed twice by the elastic sheath 41 and 42 in the throat 20 without transmitting to the handle 30. So that the hand of a player feels comfortable and will not be injured or caused a tennis elbow.

Figure 5:
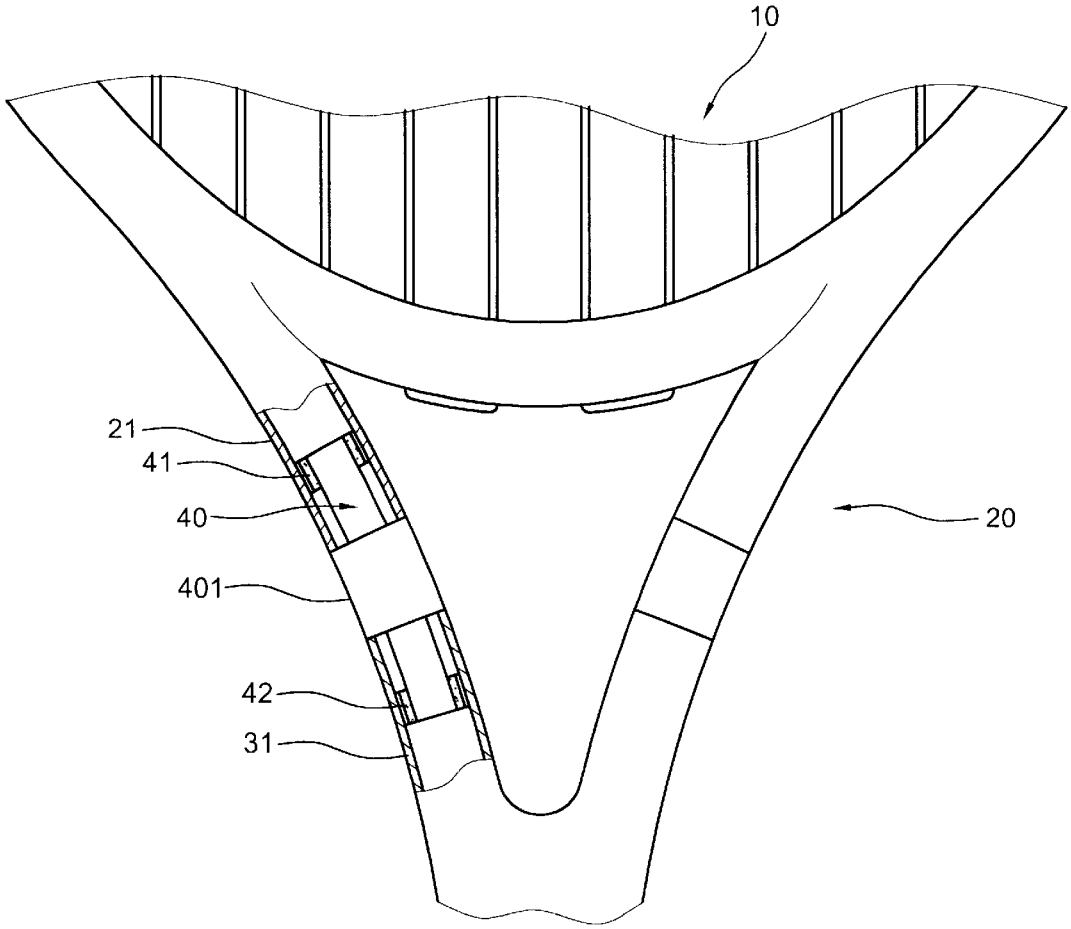
FIG. 5 is a sectional view to show an alternate embodiment of the present invention.

Referring to FIG. 5, an alternate embodiment of the present invention is provided. In this embodiment the structure and function are mostly similar to the above embodiment as described in FIGS. 1 to 4 and the above discussions are applicable in the most instances. The only different is to enlarge the diameter of the middle portion 401 of the cylindrical bar 40 to have the outer diameter of the middle portion 401 equal to the outer diameter of the branches 21 and 31. So that the pit between the branches 21 and 31 is filled up in order to have a smooth outlook.

Actually, if the cylindrical bar 40 itself is made of shockproof material. Both the elastic sheaths 41 and 42 may be omitted and directly connected the cylindrical bar 40 into the branches 21 and 31. This variation also achieves the shockproof function.

The specification relating to the above embodiment should be construed as exemplary rather than as limitative of the present invention, with many variations and modifications being readily attainable by a person of average skill in the art without departing from the spirit or scope thereof as defined by the appended claims and their legal equivalents.

I claim:

1. Elastic sheath dampers in tennis racket throat comprising:

racket having a frame, a stringing surface inside said frame, a throat separated from a handle to formed a truncated triangular configuration to form a pair first hollow interior branches spacedly extending downward from said frame;

said handle being a Y-shaped configuration to form a pair second hollow interior branches spacedly extending upward from said handle and engageable with said first hollow interior branches;

a pair of cylindrical bars respectively connecting said first branches with said second branches by adhesives, said cylindrical bars each having a pair of elastic sheaths respectively sleeved on two ends thereof and inserted into said branches with a middle portion of the cylindrical bars exposed outside of the branches;

whereby, shock waves from said frame are absorbed twice by said elastic sheaths in the throat without transmitting to said handle.

2. Elastic sheath dampers in tennis racket throat comprising:

a racket having a frame, a stringing surface inside said frame, a throat separated from a handle to form a truncated triangular configuration to form a pair of first hollow interior branches spacedly extending downward from said frame;

said handle being a Y-shaped configuration to form a pair of second hollow interior branches spacedly extending upward from said handle and engageable with said first hollow interior branches;

a pair of cylindrical bars respectively connecting said first branches with said second branches by adhesives, said cylindrical bars each having a diametrically enlarged middle portion of an outer diameter equal to the outer diameters of said branches and a pair of elastic sheaths respectively sleeved on two ends thereof and inserted into said branches with said middle portion of said cylindrical bars exposed out of said branches and looked alike to said branches;

whereby, shock waves from said frame are absorbed twice by said elastic sheaths in the throat without transmitting to said handle.

* * * * *